US005299737A

United States Patent [19]

McGinnis et al.

[11] Patent Number: 5,299,737

[45] Date of Patent: Apr. 5, 1994

[54] SPRAYING DEVICE WITH INTERMITTENT FLUSHING SYSTEM

[75] Inventors: Conrad D. McGinnis, Carmel; Dennis A. Roudebush, Fortville, both of Ind.

[73] Assignee: Curtis Dyna-Fog Ltd., Westfield, Ind.

[21] Appl. No.: 876,574

[22] Filed: Apr. 30, 1992

[51] Int. Cl.[5] ..... B05B 15/02; B05B 7/00

[52] U.S. Cl. ..... 239/77; 239/112; 239/70; 239/67; 239/305

[58] Field of Search ..... 239/77, 78, 112, 304, 239/305, 104, 280.5, 67, 68, 69, 70; 138/40, 46

[56] References Cited

U.S. PATENT DOCUMENTS

| | | | |
|---|---|---|---|
| 2,986,336 | 5/1961 | Sharkey | 239/77 |
| 3,069,091 | 12/1962 | Giesse et al. | 239/77 |
| 3,128,036 | 4/1964 | McBride | 239/77 |
| 3,421,697 | 1/1969 | Marks | 239/77 |
| 3,446,424 | 5/1969 | Wolford | 239/77 |
| 3,521,817 | 7/1970 | Curtis et al. . | |
| 4,659,013 | 4/1987 | Ledebuhr et al. | 239/77 |
| 4,714,196 | 12/1987 | McEachern et al. | 239/304 |
| 4,723,709 | 2/1988 | Curran, Jr. et al. | 239/112 |

FOREIGN PATENT DOCUMENTS

| | | | |
|---|---|---|---|
| 2813490 | 10/1978 | Fed. Rep. of Germany | 239/77 |
| 2312298 | 12/1976 | France | 239/77 |
| 713594 | 2/1980 | U.S.S.R. | 239/112 |
| 1053802 | 11/1983 | U.S.S.R. | 239/77 |

*Primary Examiner*—Andres Kashnikow
*Assistant Examiner*—Christopher G. Trainor
*Attorney, Agent, or Firm*—Woodard, Emhardt, Naughton Moriarty & McNett

[57] ABSTRACT

A spraying device having an automatic flushing system. A pressurized tank of formulation is mounted on a wheeled frame and connected to a plurality of nozzles via a three-way valve. The valve is further connected to a container of flushing medium. A programmable controller operates the three-way valve to periodically interrupt formulation flow and allow flushing medium flow through the conduits and nozzles to prevent clogging thereof. A pair of liquid sensors in the formulation conduit detect cessation of formulation flow triggering a timer operating the three-way valve causing flow of flushing medium upon completion of the formulation application. The formulation tank includes a vertically adjustable outlet tube controlling the amount of applied formulation. A centrifugal fan blows air past the nozzles carrying the emitted droplets into the atmosphere.

9 Claims, 5 Drawing Sheets

SPRAYING DEVICE WITH INTERMITTENT FLUSHING SYSTEM

BACKGROUND OF THE INVENTION

This invention is in the field of spraying and fogging devices used to emit fine spray droplets into the air.

DESCRIPTION OF THE PRIOR ART

A number of spraying and fogging devices have been devised for emitting a fine spray for application of fertilizers, insecticides, herbicides as well as sanitizing and medicinal materials such as used for poultry vaccination. Such devices are designed to be utilized outside of a building such as in a crop field or within a building for controlled air circulation. Some examples of the prior devices are disclosed in the commonly owned U.S. Pat. No. 4,343,719 whose discloses a pulse jet engine operable to power a fog producing device for atomization and delivery of various formulations including insecticides. Another device is disclosed in U.S. Pat. No. 4,643,354 wherein a plurality of nozzles located at different elevations are connected to a pressurized source of vaccination materials for application within a poultry building. The nozzles, power source and source of pressurized fluid are mounted on a wheeled carriage.

It is the custom to introduce a variety of formulations into the air of large buildings or rooms. For example, it is necessary to introduce into the air of large greenhouses a variety of substances including insecticides in order to provide for a proper environment for the plants within the greenhouse. These formulations are typically applied by ejection from nozzles with large fans provided to blow air past the nozzles thereby carrying the emitted particles throughout the greenhouse. The devices typically include a tank of formulation mounted on a wheeled frame which may be conveniently moved into the greenhouse during periods of time such as night when people are not present within the room. The devices require an operator within the room to initially activate the spraying device. As such, the operator is placed within an environmentally hazardous position for at least a portion of the operating cycle. There is therefor a need for a programmable device which may be initially set by the operator and then left to automatically cycle through the various stages of spraying.

The formulations emitted by nozzles frequently will clog the nozzles or the conduits leading from the source of formulation to the nozzles. This is particularly true in the event the formulation dries within the conduits or nozzles prior to the next application. Thus, once a particular spraying project is completed, the operator will clean the conduits and nozzles with a flushing medium. The flushing medium is contained within a tank mounted to the main frame of the spraying device and may be connected to the conduits and nozzles, thereby directing the flushing medium therethrough. Once the cleaning operation is completed, the flushing medium is unconnected from the conduits and nozzles which are in turn reconnected to the source of formulations. The spraying device is then stored ready for the next use.

Typically, a spraying operation may take a relatively long period of time such as hours to complete. Thus, in the event the conduits or nozzles become clogged prior to completion, then the spraying device becomes inoperable. In the event the spraying device is left unattended during night operations, then the clogged system is not discovered until the morning and as a result the formulations are not properly introduced into the greenhouse air. There is therefore a need for a spraying device having an automatic intermittent flushing system which will periodically flush the conduits and nozzles even though the spraying project is not completed. The spraying device may therefore be left unattended with the operator being assured that the conduits and nozzles will automatically become unclogged and the subsequent spraying completed in a timely and appropriate fashion.

SUMMARY OF THE INVENTION

A spraying device with flushing system comprising a frame and a first container mounted on the frame for holding the material to be sprayed. A nozzle is mounted on the frame along with a second container for holding a flushing medium. A fan is mounted on the frame and is operable to force air past the nozzle carrying the material emitted by the nozzle. A valve connects the nozzle with the first container and the second container and is operable to selectable direct the material and the flushing medium to the nozzle.

It is an object of the present invention to provide a new and improved spraying and fogging device.

A further object of the present invention is to provide a spraying device having an intermittent flushing system.

In addition, it is an object of the present invention to provide a programmable automatic fogging device which may be left unattended during operation.

Related objects and advantages of the present invention will be apparent in the following description.

DESCRIPTION OF THE PREFERRED EMBODIMENT

Figure 2:
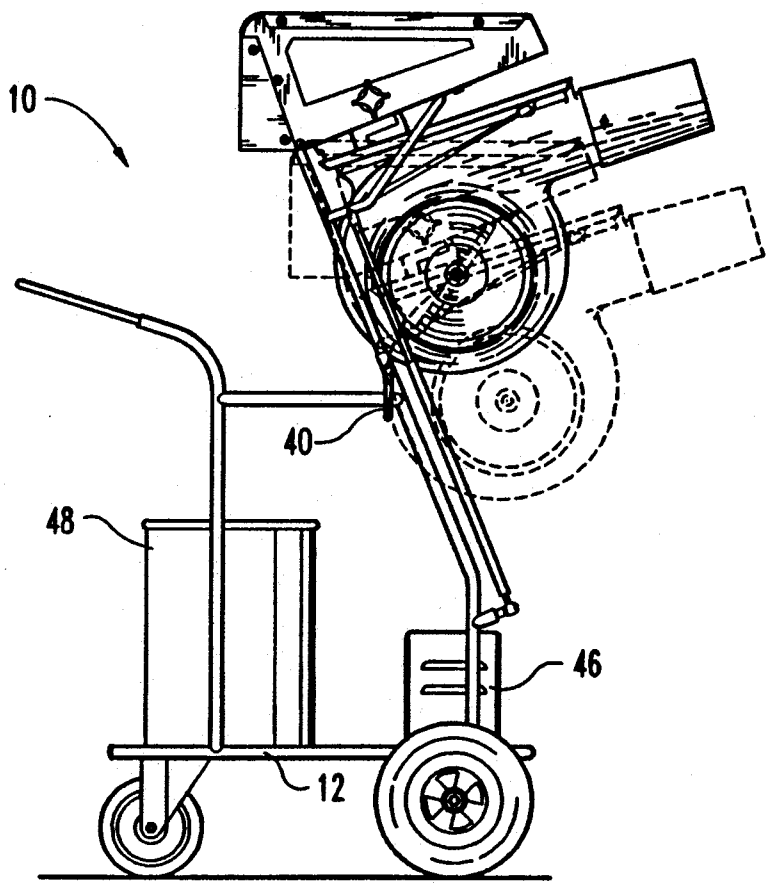
FIG. 2 is the same view as FIG. 1, only showing the fan outlet as being vertically moveable to different elevations.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
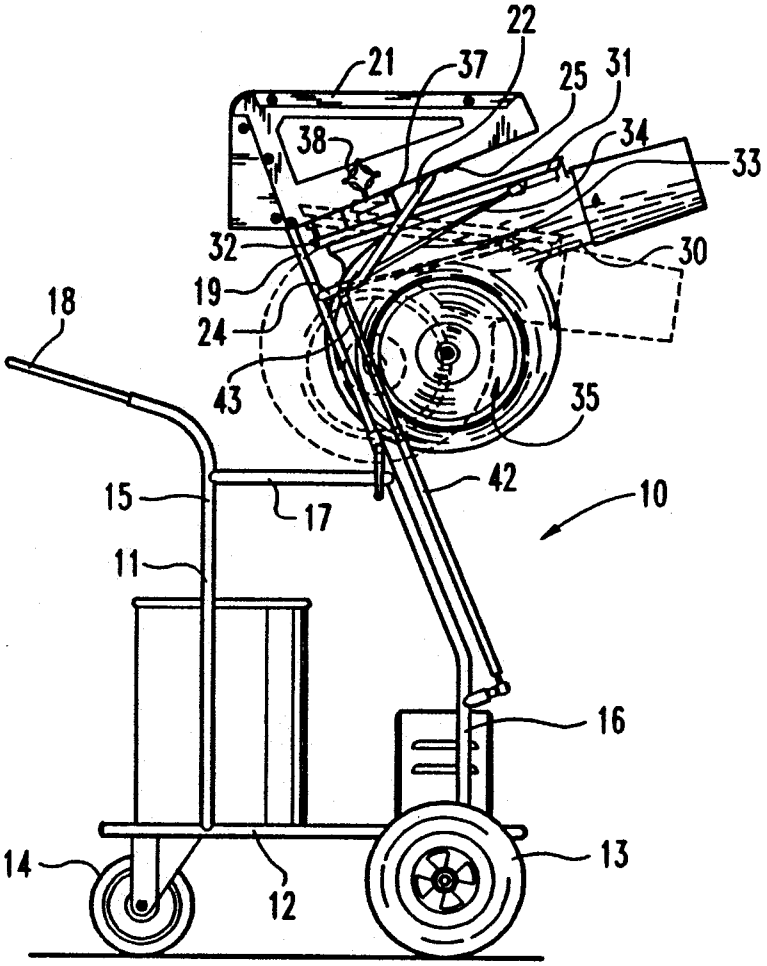
FIG. 1 is a side view of a spraying device incorporating the present invention with the fan outlet drawn in phantom as being pivotable.
Figure 3:
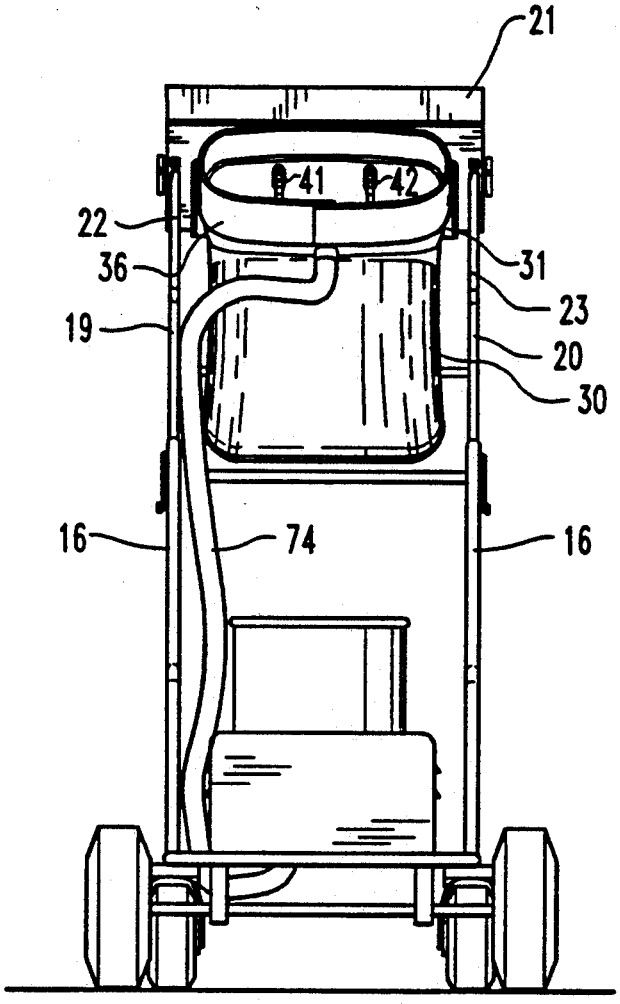
FIG. 3 is a right hand view of the device of FIG. 1.

Referring now more particularly to FIGS. 1-3, there is shown a spraying device 10 incorporating the present invention. The device includes a tubular main frame 11 forming a horizontally extending lower platform 12 with a pair of front wheels 13 and rear wheels 14 rotatably mounted thereto. The frame includes a pair of vertically extending rear tubes 15 and a pair of vertically extending front tubes 16 integrally mounted to and atop platform 12 with horizontally extending cross bars 17 integrally joined to and supporting the upper ends of tubes 15 and 16. Tubes 15 extend vertically upward and then rearwardly forming a handle 18 enabling the operator to guide and push the spraying device into position. Tubes 16 extend vertically upward and then slant rearwardly and are telescopically connected to two upper tubes 19 and 20 having fixedly mounted thereatop housing 21. A pair of support tubes 22 and 23 have proximal ends 24 fixedly connected to tubes 19 and 20 and outer ends 25 fastened to and beneath housing 21.

Fixedly mounted to and suspended beneath plate 31 is a centrifugal fan 30 with the rearward edge 32 of plate 31 pivotally mounted to and beneath housing 21 by means of a piano hinge. Thus, fan 30 along with plate 31 may pivot about rearward edge 32 and assume a downward position as indicated by the phantom lines of FIG. 1. The centrifugal fan is operable to draw air into the fan through the side openings 35 and then force or blow the air outwardly through the oval shaped outlet 36. Member 37 is fixedly attached to plate 31 and extends upwardly into housing 21 and is lockingly engaged by a conventional clamp operated by hand control 38. Thus, once plate 31 and fan 30 are at the desired angular position, hand control 38 may be rotated thereby causing the associated clamp to grip member 37 and lock plate 31 and fan 30 in position.

In addition to pivotally adjusting fan 30, the fan may be moved vertically along the axis of tubes 16 from the upward position shown by the solid lines in FIG. 2 to the lower position indicated by the phantom lines. The fan may be lowered by extending upper rods 19 and 20 downwardly into tubes 16 in telescopic fashion. A hand control 40 is mounted to a threaded member extending into tubes 16 having an inner end lockingly engaging rods 19 and 20. Thus, hand control 40 may first be loosened until the fan is vertically moved to the desired positioned and then rotated and tightened to lock rods 19 and 20 relative to tubes 16. Due to the weight of the fan 30 and housing 21, it is desirable to prevent the fan and the housing from collapsing downwardly immediately upon loosening band control 40. As a result, a pair of secondary telescopic tubes 42 are each mounted to and outwardly of vertical tubes 16. One such tube 42 is shown in FIGS. 1 and 2 with tubes 42 being removed from FIG. 3 for purposes of clarity. Tubes 42 include smaller rods 43 extendable therefrom having an upper end attached to and beneath support tubes 22 and 23. Tubes 42 and rods 43 are constructed similar to a shock absorbing device allowing rods 43 to be extended or retracted only in a controlled slow manner. Similarly, an additional pair of tubes 33 have proximal ends fixed to support tubes 22 and 23 with each tube 33 having an outer rod 34 with the distal end fixedly mounted to and beneath plate 31. One such tube 33 and associated rod 34 is illustrated in FIGS. 1 and 2 but has been removed from FIG. 3 for purposes of clarity, it being understood that an identical tube and rod is mounted on the opposite side of the machine from that shown in FIG. 1. Tubes 33 and rods 34 are similarly constructed as shock absorbing tubes and allow controlled slow pivotal motion of fan 30 and plate 31 about the rear edge 32 of plate 31.

A pair of conventional nozzles 41 and 42 are mounted within outlet 36 of fan

Figure 4:
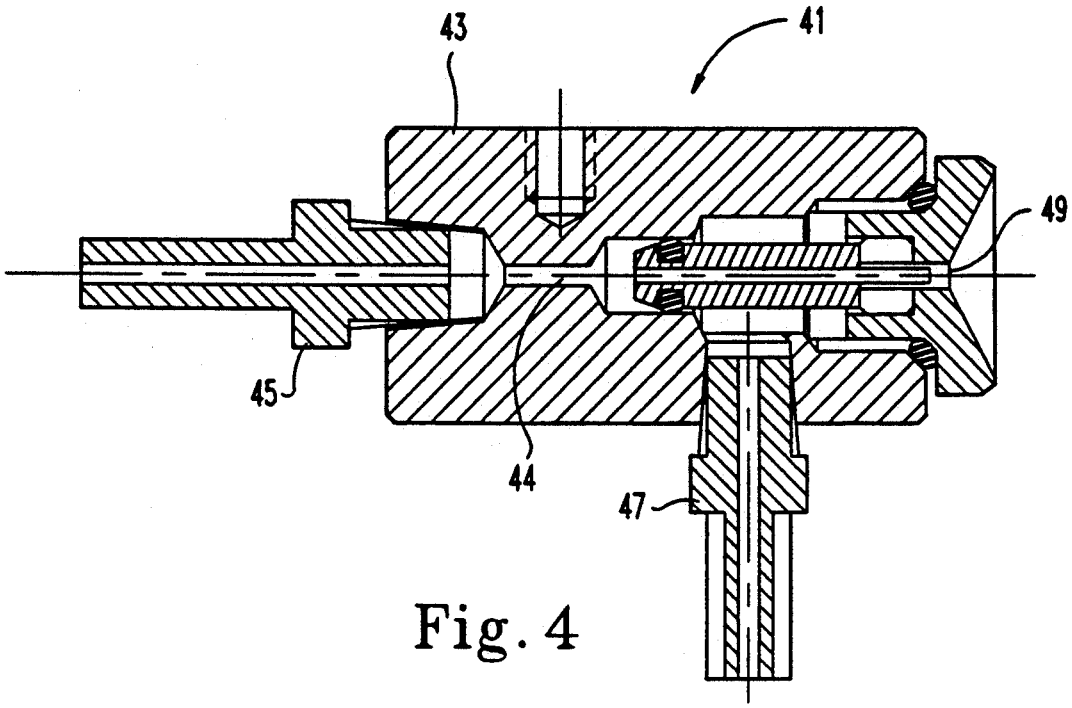
FIG. 4 is an enlarged cross sectional view of a nozzle.

A pair of conventional nozzles 41 and 42 are mounted within outlet 36 of fan 30 (FIG. 3). These nozzles are identical with a cross section of one such nozzle being shown in FIG. 4. Nozzle 41 includes a main body 43 having a central passage 44 extending therethrough. Passage 44 is connected by fitting 45 to a conduit, in turn connected to a tank 48 (FIG. 2) containing the material to be sprayed. A second fitting 47 is connected to a conduit, in turn connected to a conventional air compressor located within housing 46 mounted atop platform 12. Fitting 47 extends perpendicularly and opens into passage 44 thereby allowing the pressurized air flowing through fitting 47 and into passage 44 to carry the material flowing into the passage via fitting 45 from tank 48 outwardly through the nozzle exit 49. The exit of each nozzle 41 and 42 is positioned immediately adjacent the exhaust outlet 36 of fan 30. As the fan blows or forces air outwardly from outlet 36, the pressurized air carries the mixture of compressed air and formulation from tank 48 exiting nozzles 41 and 42.

Figure 5:
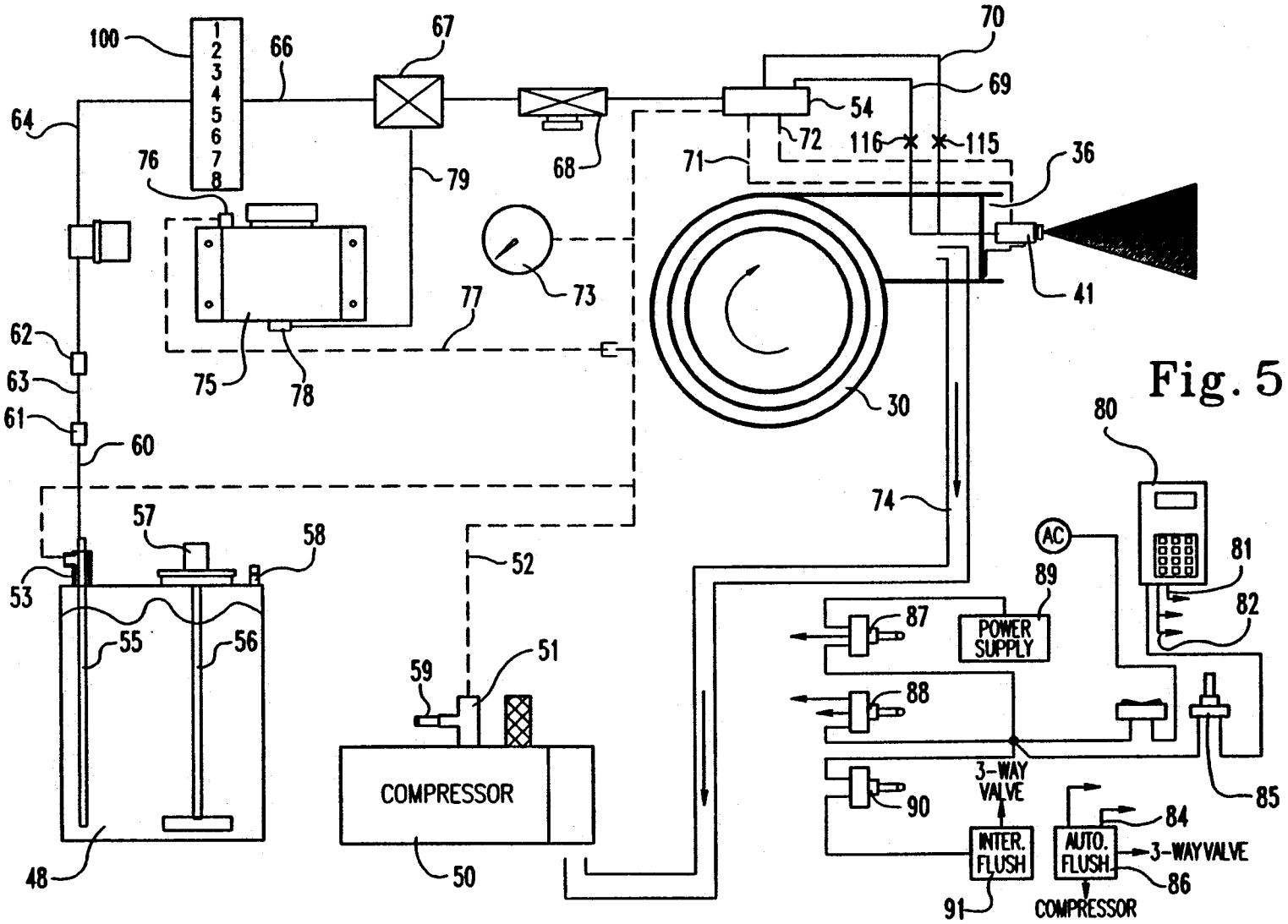
FIG. 5 is an operation system block diagram showing the major operational components of the device of FIG. 1.

A block diagram of the spraying device with intermittent flushing system is illustrated in FIG. 5. Compressor 50 mounted within housing 46 (FIG. 2) includes an outlet 51 connected by conduit 52 to fitting 53 secured to the lid of tank 48 and to air manifold 54. The compressor is operable via fitting 53 to pressurize tank 48 causing the formulation to exit the tank via a hollow and vertically moveable exit tube 55 extending through fitting 53. A conventional agitator or mixer 56 is positioned within tank 48 and is rotated by means of electric motor 57. Relief valves 58 and 59 are provided on tank 48 and the outlet of compressor 50. Exit tube 55 is connected via conduit 60 to a pair of liquid sensors 61 and 62 in fluid communication with each other via intermediate conduit 63. The fluid outlet of sensor 62 is connected via conduit 64 to a flow selector, in turn connected via conduit 66 to a conventional three-way valve 67. An operator on/off valve 68 allowing the control of the spray, in turn is positioned between three-way valve 67 and manifold 54 which are connected together by means of conduits. The formulation flows through manifold 54 and into the pair of nozzles via conduits 69 and 70 whereas the pressurized air from manifold 54 is directed to the nozzles via conduits 71 and 72.

The operator first activates the blower or fan 30 in order to ensure circulation of the air within the room. Compressor 50 is then activated pressuring formulation tank 48 as well as directing pressurized air via manifold 54 to the nozzles. A conventional pressure gauge 73 is connected to the pressurized air line. The mixer motor having previously been activated continues to agitate the formulation within the tank ensuring uniform consistency. Valve 68 may then be moved to the formulation position allowing the pressure drop within the nozzles to withdraw formulation from tank 48. Further, the flow rate of the formulation is increased due to the pressurized air directed into tank 48 via fitting 53 from compressor 50.

Centrifugal fan 30 allows for greatly increase velocities as compared to the conventional axial type fans utilized in the prior art devices. Due to the heat generated by compressor 50 located within housing 46, it is desirable to introduce cooling air to the compressor. Thus, hose 74 extends from within exhaust outlet 36 of fan 30 downwardly directing air through the bottom wall of housing 46 thereby circulating air passed the compressor. The opposite end walls of housing 46 are louvered allowing the compressed air to escape outwardly from the housing.

In certain instances, it is critical to limit the amount of formulation such as insecticide introduced into the air. While a programmable controller is included and which will be discussed later in this specification, a manual means is provided to limit the amount of formulation application. More specifically, hollow exit tube 55 is slideably mounted to fitting 53 and is adjustable to position the bottom end of the tube at a specified distance from the bottom wall of tank 48. Thus, in the event that an amount of formulation is to be dispensed equaling one-half the volume of tank 48, then the bottom end of tube 55 is positioned an equal distance between the top wall and bottom wall of tank 48, thereby preventing the formulation from entering the hollow bottom end of tube 55 once the formulation drops to an elevation midway between the top and bottom walls of the tank. A further example of such a control is to position the bottom end of the exit tube a distance from the top wall of the tube equal to one-fourth the internal heighth of tank 48 assuming a volume formulation is to be dispensed equaling only one-fourth the internal volume of the tank.

The various conduits have not been shown in FIGS. 1-3 for purposes of clarity it being understood, the various components are connected together as shown in the block diagram in FIG. 5. Likewise, the intermittent flushing system located within housing 21 has been depicted only in FIG. 5 for purposes of clarity. The intermittent flushing system includes a container 75 mounted within housing 21 having an air inlet 76 connected via conduit 77 to conduit 52 connected to compressor 50. The fluid outlet 78 of container 75 is connected via conduit 79 to three-way valve 67 which is operable to direct either formulation from conduit 66 to valve 68 or direct flushing medium contained within container 75 via conduit 79 to valve 68. Container 75 includes a lid to allow the introduction into the container of conventional flushing mediums such as cleaning liquids. The operator is therefore able to control the flow of formulation or flushing medium via three-way valve 67 to the nozzles. Automatic control is provided by a programmable controller 80 mounted to the tubular frame near handle 18. A variety of programmable controllers may be utilized; however, excellent results have been obtained by using a seven day Programmable Event Controller Model 4950H manufactured by Artisan Controls Company, Parsippany, New Jersey 07054. Controller 80 is operable to electrically and automatically control the operation of compressor 50 and fan 30 via respectively lines 81 and 82.

Commercially available liquid sensors 61 and 62 provide a resistance measurement which varies depending on whether formulation is flowing through the sensors. In other words, absence of liquid flow through the sensors results in a resistance measurement different than when formulation flows through the sensors. The resistance measurement is provided via lines 83 and 84 in turn connected to controller module 86. The module 86 is operable to activate valve 67 to direct flushing medium to the on/off valve 68 whenever formulation flow is terminated through sensor 61 and 62. Thus, at the completion of a regular formulation spraying cycle, sensors 61 and 62 will detect cessation of formulation flow, thereby activating auto flush module 86 and causing the flushing medium to flow through valve 67 and 68 to the conduits and nozzles.

Switch 85 is a two position switch with one position being manual mode and the other position being automatic mode. In the automatic mode, the programmable controller 80 is operable to control the spraying device and flushing system, whereas in the manual mode, manual toggle switches 87 and 88 are connected to power supply 89 to allow manual control respectively of fan 30 and three-way valve 67. When switch 85 is in either position, toggle switch 90 is operable to allow for the intermittent operation of the flushing system. When switch 90 is in the off position, intermittent flushing does not occur and instead the conduits and nozzles are flushed only at the completion of the spraying cycle via automatic auto flush module 86. On the other hand, when switch 90 is in the on position, a timer 91 at predetermined intervals activates three-way valve 67. For example, if timer 91 is set for five minute intervals then valve 67 will be activated to temporarily stop formulation flow and allow flushing medium flow every five minutes during the spraying cycle.

Figure 6:
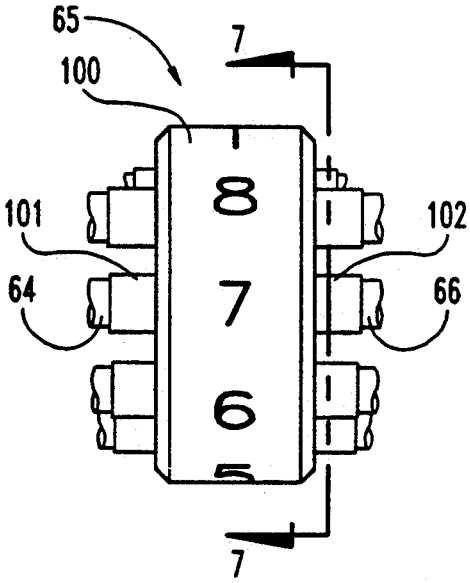
FIG. 6 is a front view of the flow selector.
Figure 7:
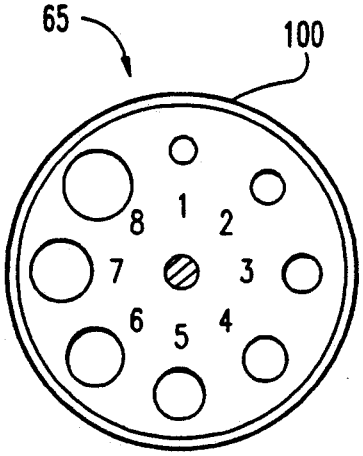
FIG. 7 is a cross sectional view taken along line 7—7 of FIG. 6 and viewed in the direction of the arrows.

Due to the many variables that must be controlled to produce a desired droplet size (that is liquid viscosity, nozzle pressure, tank pressure, temperature, relative humidity), it is extremely important to control the liquid flow rate. Conventional methods require changing nozzles, flow restrictor fittings, pump settings and tank pressure. As a result, we have devised a flow selector 65 (FIG. 5) to allow the operator to rotate the selector to one of a number of predetermined settings to obtain the droplet size necessary for the application. The selector is connected between conduit 64 and 66 and includes a wheel 100 rotatably mounted to the tubular frame of the spraying device. Conduits 64 and 66 (FIG. 6) are connectable to a plurality of in-line fittings 101 and 102. The main body of the selector wheel includes a plurality of passages extending therethrough. For example, the selector wheel depicted in FIG. 7 includes eight such passages; however, it is to be understood the selector wheel may be varied to include less than or more than eight passages. A plurality of fittings 101 and a plurality of fittings 102 are individually mounted to each particular passage. For example, a pair of fittings 101 and 102 may be fixedly mounted to the opposite ends of passage 7 and a second pair of fittings 101 and 102 are mounted to the opposite ends of passage 6 providing a total of eight such fittings 101 and eight such fittings 102. Conduits 64 and 66 may then be removably connected to the particular fittings 101/102 associated with the desired size of passage extending through the selector wheel. Fittings 101 and 102 have been removed from FIG. 7 to illustrate the different sizes of passages.

Figure 8:
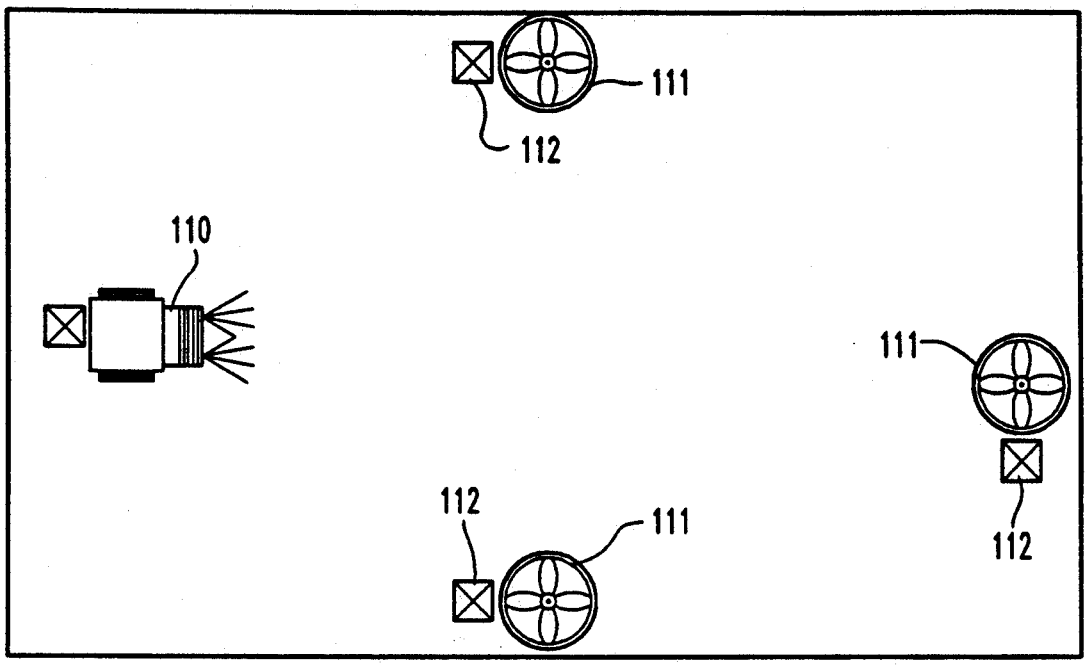
FIG. 8 is block diagram of an alternate embodiment of the device at FIG. 1 allowing for the additional remote control of external fans.
Figure 9:
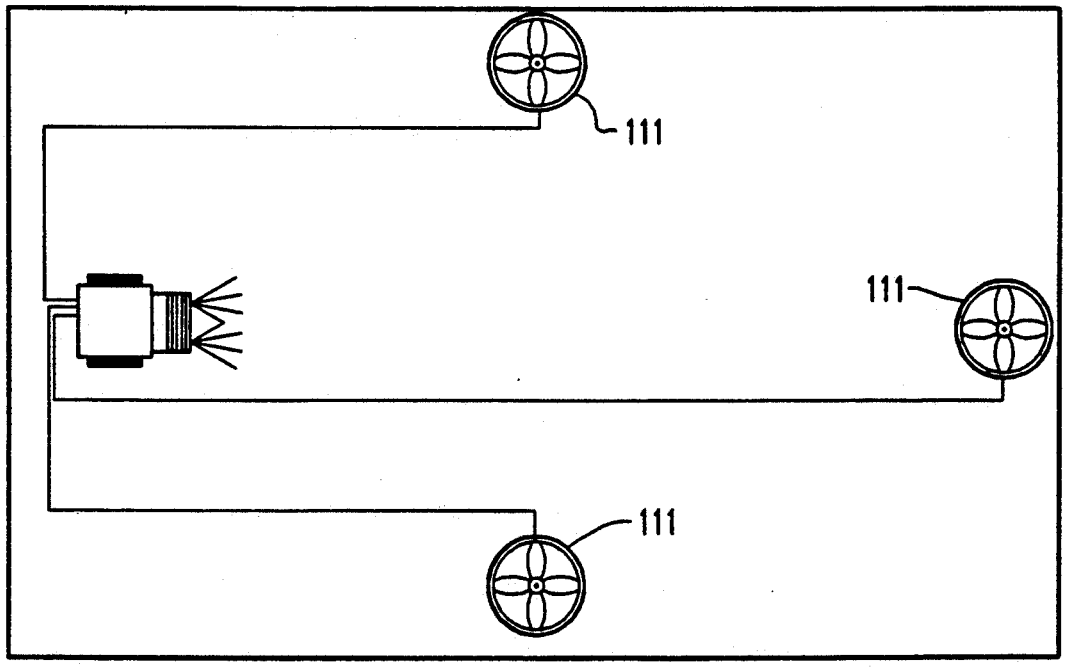
FIG. 9 is a block diagram of yet another embodiment of the device at FIG. 1 allowing control through wiring of external fans.

In general, areas to be treated in excess of 5000 square meters require additional air circulating fans to aid the fan 30 in circulating the spray. When using similar spraying machines and no operator is present, there is presently no means for activating external fans simultaneously with the machine fan. The machine disclosed herein offers the capability of interfacing with external fans with the programmable controller 80. The interface can be accomplished in one of two ways. First, by utilizing a commercially available and conventional remote control transmitter 110 which is activated simultaneously with the activation of fan 30 by programmable controller 80. The auxiliary fans 111 located remotely throughout the room include commercially available and conventional receivers 112 which receive the signal transmitted by transmitter 110 (FIG. 8), thereby turning on and off the power to fans 111. Alternatively, fans 111 may be hard wired to the controller 80 to be activated on and off simultaneously with the activation of fan 30.

The programmable controller allows spraying to take place without an operator present in the room. The controller uses an eight event, seven day timing pattern. Since best spray results are achieved if an air pattern is first established in the area to be sprayed prior to spraying, a typical programming sequence would be as follows: The first event—fan on for 15 minutes; Second event—fan and spray on for the time required to empty the formulation tank; and third event—spray off and fan on for 15 minutes. Once programmed, all information is retained in the memory of the programmable controller even if power is disconnected.

To keep from having to program the controller for small spray operations, switch 85 may be moved to the manual position as opposed to automatic position for program spraying. When selected, the manual mode overrides all programmed functions. To prevent over applying chemical and to enable the machine to operate without anyone present, the formulation stand pipe 55 is adjusted to the proper depth to apply the desired amount of liquid. Grooves on the stand pipe are precalibrated to aid the operator in adjusting the proper depth.

Since many of the formulations that will be sprayed are mixed with water, it is normal for the mixtures to settle out during spraying and deposit in the liquid carrying system. These deposits cause restrictions in the liquid carrying lines and a reduction in flow rate. This, in turn causes a change in the size of droplets being produced. It is important that the correct droplet size be produced for each different application, and thus a significant change in liquid flow rate during an application is not acceptable. The intermittent flushing system helps to prevent this problem by cycling the machine three way valve 67 during the spray application from the formulation spray mode to the flush mode every five minutes for a period of 15 seconds. The flushing medium or liquid has a significantly higher pressure than the formulation liquid helping to remove the deposits. In this regard, in one embodiment, compressor 50 produces a pressure head of 8 psi which is applied directly to flush container 75 and formulation container 48. Relief valve 58 maintains a constant or maximum 4 psi pressure within container 48.

When the spray application is completed, formulation residue left in the liquid lines can harden and be very difficult to clean. The automatic flushing system senses when the machine has emptied its formulation tank via sensor 61 and 62 and activates the three way cyclical valve 67 to the flush position. The machine will continue to flush until the flush tank is empty.

Once the spray droplets are created by the nozzles, they must be propelled so that they can reach their intended target. The conventional way of achieving this is by using an axial type fan or fans positioned behind the nozzles. The machine disclosed herein uses a centrifugal type, adjustable speed blower. The main advantage of the centrifugal blower is that it produces a much higher air velocity at its discharge end yet still produces an adequate air flow. This higher velocity of air has proven to propel spray droplets as far as machines using two axial fans with less velocity and more air flow. Because of high air velocity, oversized droplets are less likely to fall out of the air and impinge on crops near the machine and more likely to be distributed throughout the target area.

Many variations are contemplated and included in the present invention. For example, the conduits may be connected in a variety of different paths to achieve the desired objectives. One way flow valves may be utilized to prevent cross flow of formulation between nozzles. For example, one way valves 115 and 116 are located in conduits 69 and 70 to prevent formulation flow from one nozzle to the adjacent nozzle thereby preventing a nozzle having a superior flow rate from assuming a superior position disrupting an even spray pattern. The machine disclosed herein may be utilized within a room or external of a building.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A spraying device to spray material and having a flushing system comprising:

frame means;

a first container mounted on said frame means for holding the material to be sprayed;

nozzle means mounted on said frame means;

a second container mounted on said frame means for holding a flushing medium;

fan means mounted on said frame means operable to force air past said nozzle means carrying said material emitted by said nozzle means;

valve means connecting said nozzle means with said first container and said second container and operable to selectable direct said material and said flushing medium to said nozzle means;

pressure means in communication with said second container and operable to force said flushing medium through said nozzle means when said valve means directs flow of said flushing medium rather than said material to said nozzle means;

detection means operable to determine when said material is not flowing from said first container to said nozzle means; and, control means connected to said detection means and operable to switch said valve means to direct flow of said flushing medium to said nozzle means when said detection means detects absence of material flow from said first container to said nozzle means.

2. The spraying device of claim 1 and further comprising:

timing means connected to said valve means and operable to periodically switch said valve means to block flow of said material from said first container to said nozzle means and direct said flushing medium to said nozzle means.

3. A spraying device to spray material and having a flushing system comprising:

flame means;

a first container mounted on said frame means for holding the material to be sprayed;

nozzle means mounted on said frame means;

a second container mounted on said frame means for holding a flushing medium;

fan means mounted on said frame means operable to force air past said nozzle means carrying said material emitted by said nozzle means;

valve means connecting said nozzle means with said first container and said second container and operable to selectable direct said material and said flushing medium to said nozzle means;

automatic means to preset activation of said valve means;

pressure means in communication with said second container and operable to force said flushing medium through said nozzle means when said valve means directs flow of said flushing medium rather than said material to said nozzle means;

flow selecting means mounted on said frame means and connected between said first container and said nozzle means, said flow selecting means including flow restrictors operable to selectable control the flow rate of said material from said first container to said nozzle means;

said flow selecting means including a member with a plurality of different sized passages extending therethrough with said passages providing control of flow of said material therethrough;

an additional air fan located remote from said frame means; and, auxiliary means mounted on said frame means and operable to activate said additional air fan to assist circulation of said material emitted by said nozzle means.

4. A spraying device to spray material and having a flushing system comprising:

frame means;

a first container mounted on said frame means for holding the material to be sprayed;

nozzle means mounted on said frame means;

a second container mounted on said frame means for holding a flushing medium;

fan means mounted on said frame means operable to force air past said nozzle means carrying said material emitted by said nozzle means;

valve means connecting said nozzle means with said first container and said second container and operable to selectable direct said material and said flushing medium to said nozzle means; and, automatic means to preset activation of said valve means;

pressure means in communication with said second container and operable to force said flushing medium through said nozzle means when said valve means directs flow of said flushing medium rather than said material to said nozzle means; and wherein:

said frame means includes a plurality of telescopically constructed members upon which said fan means is supported allowing positioning of said fan means to direct said material emitted by said nozzle means.

5. The spraying device of claim 4, wherein:

said fan means includes a centrifugal fan; and, said pressure means includes a compressor; and further comprising:

conduit means extending from said centrifugal fan to said compressor operable to direct cooling air from said fan to said compressor.

6. A spraying device to spray material and having a flushing system comprising:

frame means;

a first container mounted on said frame means for holding the material to be sprayed;

nozzle means mounted on said frame means;

a second container mounted on said frame means for holding a flushing medium;

fan means mounted on said frame means operable to force air past said nozzle means carrying said material emitted by said nozzle means;

valve means connecting said nozzle means with said first container and said second container and operable to selectable direct said material and said flushing medium to said nozzle means; and, automatic means to preset activation of said valve means;

pressure means in communication with said second container and operable to force said flushing medium through said nozzle means when said valve means directs flow of said flushing medium rather than said material to said nozzle means; and, an outlet tube movable mounted to said first container which has a bottom wall, said tube when fully inserted in said first container having a bottom end located near the bottom wall of said first container to withdraw all of said material within said first container and movable to intermediate positions wherein said bottom end is located remote from said bottom wall of said first container to limit the amount of said material to be withdrawn from said first container.

7. A spraying device for spraying material comprising:

frame means;

a first container mounted on said frame means for holding the material to be sprayed;

nozzle means mounted on said frame means;

a second container mounted on said frame means for holding a flushing medium;

fan means mounted on said frame means operable to force air past said nozzle means carrying said material emitted by said nozzle means;

valve means connecting said nozzle means with said first container and said second container and operable to selectable direct said material and said flushing medium to said nozzle means;

timing means connected to said valve means and operable to periodically switch said valve means to block flow of said material from said first container to said nozzle means and direct said flushing medium to said nozzle means; and, pressure means in communication with said second container and operable to force said flushing medium through said nozzle means when said valve means directs flow of said flushing medium rather than said material to said nozzle means; and wherein:

said fan means includes a centrifugal fan; and said pressure means includes a compressor; and further comprising:

conduit means extending from said centrifugal fan to said compressor operable to direct cooling air from said fan to said compressor.

8. A spraying device for spraying material comprising:

frame means;

a first container mounted on said frame means for holding the material to be sprayed;

nozzle means mounted on said frame means;

a second container mounted on said frame means for holding a flushing medium;

fan means mounted on said frame means operable to force air past said nozzle means carrying said material emitted by said nozzle means;

valve means connecting said nozzle means with said first container and said second container and operable to selectable direct said material and said flushing medium to said nozzle means;

flow selecting means mounted on said frame means and connected between said first container and said nozzle means, said flow selecting means including flow restricters operable to selectable control the flow rate of said material from said first container to said nozzle means;

detection means operable to determine when said material is not flowing from said first container to said nozzle means; and, control means connected to said detection means and operable to switch said valve means to direct flow of said flushing medium to said nozzle means when said detection means detects absence of material flow from said first container to said nozzle means.

9. A spraying device for spraying material comprising:

frame means;

a first container mounted on said frame means for holding the material to be sprayed;

nozzle means mounted on said frame means;

a second container mounted on said frame means for holding a flushing medium;

fan means mounted on said frame means operable to force air past said nozzle means carrying said material emitted by said nozzle means;

valve means connecting said nozzle means with said first container and said second container and operable to selectable direct said material and said flushing medium to said nozzle means;

flow selecting means mounted on said frame means and connected between said first container and said nozzle means, said flow selecting means including flow restricters operable to selectable control the flow rate of said material from said first container to said nozzle means; and wherein:

said frame means includes a plurality of telescopically constructed members upon which said fan means is supported allowing positioning of said fan means to direct said material emitted by said nozzle means.

* * * * *